United States Patent [19]

Kniepkamp

[11] 3,986,425

[45] Oct. 19, 1976

[54] BASS SIGNAL CONTROL CIRCUIT

[75] Inventor: Alberto Kniepkamp, Arlington Heights, Ill.

[73] Assignee: Norlin Music, Inc., Lincolnwood, Ill.

[22] Filed: June 4, 1975

[21] Appl. No.: 583,747

[52] U.S. Cl. ..... 84/1.17; 84/1.03; 84/1.09; 84/1.21; 84/1.11

[51] Int. Cl.[2] ..... G10H 3/06

[58] Field of Search ..... 84/1.01, 1.09, 1.1, 84/1.11, 1.12, 1.19, 1.21, 1.22, 1.23, DIG. 25, 1.17, 1.63

[56] References Cited

UNITED STATES PATENTS

| | | | |
|---|---|---|---|
| 3,530,224 | 9/1970 | Plunkett et al. | 84/1.19 X |
| 3,663,735 | 5/1972 | Evans | 84/1.11 |
| 3,749,809 | 7/1973 | Niinomi | 84/1.11 X |

*Primary Examiner*—Ulysses Weldon

[57] ABSTRACT

This invention relates to a circuit for use in an electronic musical instrument such as an organ, the instrument having two separate sources of bass signals and transducing elements for converting the bass signals into a sound output. The circuit is operative to prevent signals from one of the sources from being applied to the transducing elements when signals from the other source are present. For a preferred embodiment, a predetermined signal, such as a keying signal, is generated when signals from the other source are present and this predetermined signal is utilized to shunt signals from the other source to ground or to otherwise inhibit the application of these signals to the transducing elements.

6 Claims, 1 Drawing Figure

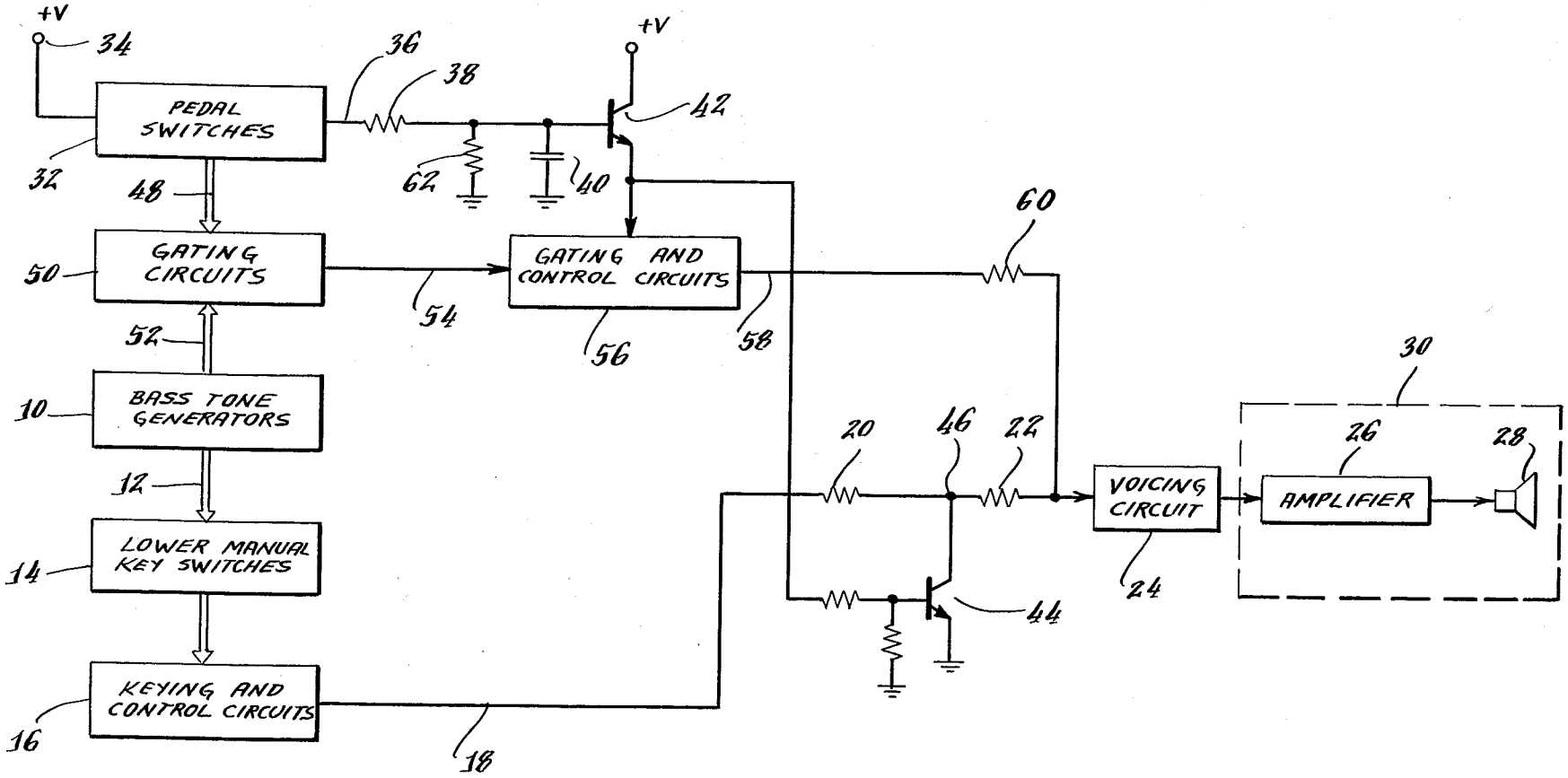
+V
34
PEDAL SWITCHES
32
48
GATING CIRCUITS
50
52
BASS TONE GENERATORS
10
12
LOWER MANUAL KEY SWITCHES
14
KEYING AND CONTROL CIRCUITS
16
18
36
38
62
40
42
+V
GATING AND CONTROL CIRCUITS
56
54
58
60
20
22
46
44
VOICING CIRCUIT
24
30
26
AMPLIFIER
28

BASS SIGNAL CONTROL CIRCUIT

BACKGROUND

1. Field of the Invention

This invention relates to electronic musical instruments and more particularly to a circuit for controlling bass signals in such an instrument.

2. The Prior Art

Electronic organs normally have an upper keyboard for playing melody notes, a lower keyboard for playing chord or accompaniment notes, and a pedal board for playing bass notes. In order to simplify playing of the organ, some recent models have incorporated an automatic bass feature which permits additional outputs to be obtained when one or more keys on a manual keyboard are depressed which outputs are utilized to control the application of selected bass tone signals to the output. This control may, for example, include the alternate playing of the selected bass notes under control of a rhythm generating devise. Thus, the selected high and low bass notes may be alternatively sounded or the selected root and fifth notes may be alternatively sounded under control of the organs rhythm generator.

Heretofore, if the musician operated the bass pedals while the organ was providing automatic bass outputs, both sets of outputs would be provided to the organ amplifiers and speakers. This double signal could cause the power capabilities of the amplifiers and speakers to be exceeded, causing distortion in the output from and possible damage to these elements. In addition, the sounding of notes from the two different bass sources simultaneously could produce a musically unpleasant sound. However, without the facility of generating bass notes from the pedal board, the musical capabilities of the instrument are somewhat restricted. For example, it is not possible to hold a selected one or more bass notes while changing lower keyboard notes when operating in the automatic bass mode. A need therefore exists for an inexpensive and simple circuit to permit automatic bass notes to be suppressed when the musician elects to play notes from the pedal board and to return to an automatic bass mode when playing of notes from the pedal board terminates.

SUMMARY OF THE PRESENT INVENTION

In accordance with the above, this invention provides an electronic musical instrument such as an organ having first and second sources of bass frequency signals and a transducing means for converting signals from such sources into a sound output from the instrument. The instrument has a circuit for preventing signals from the first bass source from being applied to the transducing means when signals from the second bass source are present. For the preferred embodiment, the first bass source is an automatic bass derived from a manual keyboard of the instrument such as the lower manual and the second bass source is a bass source derived from the instrument's pedal switches. The circuit includes means for applying signals from the first bass source to the transducing means, means for applying signals from the second bass source to the transducing means, means for generating a predetermined signal when signals from the second bass source are present, and means responsive to the predetermined signal for preventing the application of signals from the first bass source to the transducing means. For a preferred embodiment of the invention, the means for preventing includes means for shunting signals from the first bass source to ground.

The foregoing and other objects, features and advantages of the invention will be apparent from the following more particular description of a preferred embodiment of the invention as illustrated in the accompanying drawing.

BRIEF DESCRIPTION OF THE DRAWINGS

The single FIGURE is a semi-block schematic diagram of the circuit of a preferred embodiment of the invention.

DETAILED DESCRIPTION

Referring to the FIGURE, bass frequency tones from bass frequency tone generators 10 are applied through lines 12 to a set of key switches 12 operated by depressing the keys of the lower manual keyboard of the instrument. There is a line 14 for each of the bass frequency tones, there normally being 12 such tones. The depression of selected keys of the organs lower manual keyboard causes one or more of the key switches 14 to be closed. The closing of key switches 14 permits one or more tone signals from generators 10 to be applied to keying and control circuit 16. The lowest or highest ones of the keys depressed on the lower manual keyboard may be utilized to select the high-low or root fifth notes of the bass or the highest key depressed on the lower manual may be utilized to select the highest bass note and the lowest key depressed the lowest bass note. Circuitry 16 includes keying circuits for achieving desired attack, sustain, and decay for the selected notes, and may also include circuitry for causing the selected notes in the bass to be sounded alternatively under control of a rhythm device or other means. Circuit 10, 14, and 16 may be considered as a first source of bass signals, the outputs from this source appearing on output line 18 from circuit 16. The exact nature of the circuitry of elements 10, 14 and 16 does not form part of the present invention and will not be described further. Such circuitry is, however, well known in the art, being utilized in a number of existing organs including the Lowrey Organ Company model No. TG-44.

The automatic bass signals on line 18 are applied through resistors 20 and 22 to a standard voicing circuit 24. Circuit 24 modifies the shape of the waveform in a manner which does not form part of the present invention to obtain various instrumental effects and applies its output through amplifier 26 to speaker 28. Amplifier 26 and speaker 28 form a standard output transducing means 30 for the instrument.

When one or more of the pedal switches 32 are closed, these switches being closed by the operator pressing on a pedal of the instrument pedal board, (not shown) the positive voltage on terminal 34 is applied through the closed switch to line 36. The positive voltage on line 36 is applied through resistor 38 to charge capacitor 40. As capacitor 40 charges, the potential at the base of keying transistor 42 increases causing this transistor to become increasingly conductive. As transistor 42 becomes increasingly conductive, the potential at the emitter of the transistor likewise becomes more positive causing a more positive potential to be applied to the base of transistor 44. As the potential applied to the base of transistor 44 increases, the effective resistance of this transistor decreases, permitting transistor 44 to serve as a shunt path from point 46 (between resistors 20 and 22) to ground. Thus, as capacitor 40 charges, an increasing portion of the automatic bass signal appearing at point 46 is shunted through transistor 44 to ground. When capacitor 40 is fully charged, the positive potential applied to the base of transistor 44 is sufficient so as to render this transistor a virtual short circuit path to ground causing substantially all of the sutomatic bass signals on line 18 to be shunted to ground therethrough.

The closing of each pedal switch 32 also causes a signal corresponding to the closed switch to be applied through a corresponding line 48 to a corresponding gate in gating circuit 50. There is a gate 50 for each of the bass tone generators 10, the signal from each bass tone generator being applied through a line 52 to the corresponding gate in circuit 50. Thus, a tone corresponding to each of the operated pedals appears on output line 54 from gating circuits 50, this signal being applied to gating and control circuits 56. The signal at the emitter of keying transistor 42 is applied as another input to circuit 56, circuit 56 passing increasing portions of the signal on line 54 as the potential at the emitter of transistor 42 becomes more positive. Circuits 10, 32, 50, and 56 form a second source of bass signals. As with the circuits of the first source of bass signals, the specifics of these circuits do not form part of the present invention and may be any one of a number of existing circuits for performing the required function. An example of circuitry suitable for performing this function may be found in the Lowrey Organ Company Model TG 44.

The pedal bass signal on line 58 is applied through resistor 60 and voicing circuit 24 to transducing circuit 30. Thus, the circuit of this invention provides a capability for normally passing automatic bass signals to transducing circuit 30 but for inhibiting the passage of these signals when pedal bass signals are present and for passing only the pedal bass signals on line 58 to transducer circuit 30 under these conditions. To avoid a sharp transition between the signals from the two bass sources when the automatic bass signals are phased out the pedal bass signals are phased in as the keying potential at the emitter of keying transistor 42 increases.

When playing of pedal bass notes terminates so that a positive potential no longer appears on line 36, capacitor 40 slowly discharges through resistor 62 to ground. As capacitor 40 discharges, the potential at the emitter of transistor 42 becomes less positive causing the amplitude of the pedal bass signal on line 58 to gradually decrease, and causing transistor 44 to become less conductive, permitting a portion of the automatic bass signal on line 18 to pass to transducing circuit 30. A sustain capability is provided in gating circuit 50 so that signal remains on line 54 until capacitor 40 is fully discharged. When capacitor 40 has fully discharged, circuit 56 no longer passes signal on line 54 to line 58 and transistor 44 becomes cut off permitting the automatic bass signal on line 18 to again pass to the transducing circuit. The circuit thus glides back into the automatic bass mode without any sharp transitions. It is noted that the decay time for capacitor 40 is sufficient so that the instrument will not return to the automatic bass mode between playing of pedal notes, the capacitor becoming fully discharged only when playing of pedal notes terminates.

A simple and inexpensive circuit has thus been provided for giving priority to pedal bass signals over automatic bass signals with the transitions between pedal and automatic bass signals being accomplished gradually. While illustrative circuitry has been provided for the pedal and automatic bass signal sources, this circuitry does not form part of the present invention and any circuitry adapted to serve as sources of first and second bass signals might be utilized. Similarly, any suitable voicing and transducing circuitry might be utilized. While for the preferred embodiment, the automatic bass signals are shunted to ground under the control of the pedal bass keying signal, equivalent means for blocking the automatic bass signals and/or providing the controlling potential might also be utilized. Thus, while the invention has been particularly shown and described above with reference to a preferred embodiment, the foregoing and other changes in form and detail might be made therein without departing from the spirit and scope of the invention.

What is claimed is:

1. In an electronic musical instrument having automatic means for producing bass frequency note signals in response to the actuation of manual control elements, pedal means for producing bass frequency note signals in response to the actuation of pedal control elements, and transducing means for converting said signals into a sound output of the instrument, a circuit for preventing signals from the automatic means from being applied to the transducing means when signals from the pedal means are present comprising:

means for applying signals from said automatic means to said transducing means;

means for applying signals from said pedal means to said transducing means;

means responsive to the actuation of the pedal control element for generating a predetermined control signal; and means responsive to said predetermined signal for inhibiting the application of said signals from said automatic means to said transducing means.

2. A circuit as claimed in claim 1 wherein said pedal control elements are bass pedals of a bass pedal board; and wherein said predetermined signal is a keying signal which is generated in response to the actuation of a bass pedal.

3. A circuit as claimed in claim 2 wherein said keying signal has a predetermined rise and decay time; and wherein said means for inhibiting includes means for gradually reducing the signal from said automatic means which is applied to the transducing means as said keying signal rises and for gradually increasing the signal from said automatic means which is applied to the transducing means as said keying signal decays.

4. A circuit as claimed in claim 3 wherein said means for inhibiting includes means for shunting signals from said automatic means to ground, said means shunting increasing portions of said signal to ground as said keying signal increases.

5. A circuit as claimed in claim 1 wherein said means for inhibiting includes means for shunting signals from said automatic means to ground.

6. A circuit as claimed in claim 1 wherein said means for inhibiting includes means for gradually reducing the signal from said automatic means which is applied to the transducing means as the signal from said pedal means increases and for gradually increasing the signal from said automatic means which is applied to the transducing means as the signal from the pedal means decreases.

* * * * *